US008805227B2

(12) United States Patent
Tamura

(10) Patent No.: US 8,805,227 B2
(45) Date of Patent: Aug. 12, 2014

(54) IMAGE FORMING APPARATUS

(75) Inventor: Nobuyasu Tamura, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 193 days.

(21) Appl. No.: 13/606,870

(22) Filed: Sep. 7, 2012

(65) Prior Publication Data

US 2013/0084094 A1 Apr. 4, 2013

(30) Foreign Application Priority Data

Sep. 30, 2011 (JP) ..... 2011-217127

(51) Int. Cl.
*G03G 15/20* (2006.01)

(52) U.S. Cl.
CPC ..... *G03G 15/205* (2013.01)
USPC ..... 399/70; 399/67; 399/69

(58) Field of Classification Search
USPC ..... 399/67, 69, 70
See application file for complete search history.

(56) References Cited

U.S. PATENT DOCUMENTS

| | | | | |
|---|---|---|---|---|
| 5,701,554 | A * | 12/1997 | Tanaka et al. | 399/69 |
| 6,263,172 | B1 * | 7/2001 | Suzuki et al. | 399/67 |
| 2007/0059009 | A1 | 3/2007 | Nakayama | |
| 2009/0263151 | A1 | 10/2009 | Deguchi et al. | |
| 2010/0034548 | A1 * | 2/2010 | Naitoh et al. | 399/69 |
| 2010/0104307 | A1 | 4/2010 | Shinyama | |
| 2012/0087682 | A1 | 4/2012 | Deguchi et al. | |

FOREIGN PATENT DOCUMENTS

| | | | |
|---|---|---|---|
| JP | 11-073056 | A | 3/1999 |
| JP | 2000-242126 | A | 9/2000 |
| JP | 2007-033618 | A | 2/2007 |
| JP | 2007-108663 | A | 4/2007 |
| JP | 2007-187833 | A | 7/2007 |
| JP | 2009-265154 | A | 11/2009 |
| JP | 2010-102126 | A | 5/2010 |

OTHER PUBLICATIONS

Office Action (Notification of Reasons of Refusal) issued on Oct. 22, 2013, by the Japanese Patent Office in corresponding Japanese Patent Application No. 2011-217127, and an English Translation of the Office Action. (7 pages).

* cited by examiner

*Primary Examiner* — Ryan Walsh
(74) *Attorney, Agent, or Firm* — Buchanan Ingersoll & Rooney PC

(57) ABSTRACT

An image forming apparatus including a heating rotating body (first body) and a pressurizing rotating body (second body) disposed in a pressure contact state, and commencing image forming when a temperature of the first body reaches a predetermined temperature lower than a fixing temperature. The apparatus acquires a value indicating a temperature of the second body upon commencement of warm-up, and when the value is below a threshold value, heats the first body until the temperature thereof reaches the fixing temperature while rotating the two bodies at a first speed, and when the value equals or exceeds the threshold value, heats the first body until the temperature thereof reaches the predetermined temperature while rotating the two bodies at a second speed slower than the first speed and further heats the first body until the temperature thereof reaches the fixing temperature while rotating the two bodies at the first speed.

6 Claims, 9 Drawing Sheets

FIG. 11

| | | Continuous operation period of fixing device | | | | |
|---|---|---|---|---|---|---|
| | | 1 minute | 5 minutes | 10 minutes | 20 minutes | 30 minutes |
| Sleep continuation period | 10 minutes | 73℃ | 93℃ | 100℃ | 105℃ | 110℃ |
| | 30 minutes | 45℃ | 59℃ | 65℃ | 72℃ | 77℃ |
| | 60 minutes | 30℃ | 40℃ | 45℃ | 51℃ | 54℃ |
| | 90 minutes | 25℃ | 33℃ | 35℃ | 38℃ | 40℃ |
| | 120 minutes | 23℃ | 25℃ | 26℃ | 28℃ | 30℃ |

FIG. 12

| | | Continuous operation period of fixing device | | |
|---|---|---|---|---|
| | | Shorter than 1 minute | 1-10 minutes | Longer than or equal to 10 minutes |
| Sleep continuation period | Shorter than 30 minutes | Normal speed | Lowest speed | Lowest speed |
| | 30-60 minutes | Normal speed | Low speed | Lowest speed |
| | 60-90 minutes | Normal speed | Normal speed | Low speed |
| | Longer than or equal to 90 minutes | Normal speed | Normal speed | Normal speed |

IMAGE FORMING APPARATUS

CROSS-REFERENCE TO RELATED APPLICATIONS

This application is based on application No. 2011-217127 filed in Japan, the contents of which are hereby incorporated by reference.

BACKGROUND OF THE INVENTION (1) Field of the Invention

The present invention relates to a technology for an image forming apparatus such as a printer and a copier, and in particular, to a technology for controlling a warm-up operation of a fixing device included in the image forming apparatus, particularly upon commencement of the warm-up operation.

(2) Related Art

Image forming apparatuses, such as a printer and a copier, are provided with a fixing device for heat-fixing an unfixed image formed on a recording sheet onto the recording sheet. For such a fixing device to perform heat-fixing, it is required that the fixing device be warmed up so that the temperature of the fixing device reaches a predetermined target temperature (for instance, 180° C.).

In a commonly-used fixing device including a heating rotating body (a heating roller or a heating belt) and a pressurizing rotating body (a pressurizing roller or a pressurizing belt) that are disposed in a pressure contact state where the pressurizing rotating body contacts and applies pressure to the heating rotating body, warm up of the fixing device is performed while causing the rotating bodies to rotate in the above-described pressure contact state. By warming up the fixing device in such a manner, the fluctuation of the surface temperature of the pressurizing rotating body is reduced, and hence, the surface temperature of the pressurizing rotating body is stabilized. Further, this leads to preventing the occurrence of uneven fixation when printing (image forming processing) is commenced following the completion of the warm up of the fixing device.

In so as to quickly stabilize the surface temperature of the pressurizing rotating body during the warm up of the fixing device, it is desirable that both rotating bodies be caused to rotate at a comparatively high speed. However, when increasing the speed at which the rotating bodies are caused to rotate (for example, when warming up the fixing device while causing both rotating bodies to rotate at a speed equivalent to the speed at which the rotating bodies are caused to rotate during heat-fixing in the image forming processing), the following problems arise. That is, the increase in the speed at which the rotating bodies are caused to rotate leads to an increase in the amount of heat transferring from the heating rotating body to the pressurizing rotating body during the warm up of the fixing device. When an increased amount of heat transfers from the heating rotating body to the pressurizing rotating body during the warm up of the fixing device, the temperature of the heating rotating body does not rise as desired. Due to this, a comparatively great amount of time is required for the surface temperature of the heating rotating body to reach the above-described target temperature, and accordingly, the amount of time required to warm up the fixing device increases.

Such an increase in the amount of time required for warming up the fixing device is particularly problematic in image forming apparatuses capable of performing quick print processing, which have been coming into use recently. An image forming apparatus capable of performing quick print processing cuts down the time from the commencement of the warm up of the fixing device to the commencement of the image forming processing by terminating the warm up of the fixing device and commencing the image forming processing when the temperature of the heating rotating body reaches a print-executable temperature. The print-executable temperature is such that, when the temperature of the heating rotating body reaches the print-executable temperature through the warm up of the fixing device, the temperature of the heating rotating body can reach a fixing temperature when the first recording sheet arrives at a fixing nip of the fixing device. In such an image forming apparatus capable of performing quick print processing, it is desirable that the amount of time required to warm up the fixing device be reduced to as short a time as possible.

In order to cut down the amount of time required to warm up the fixing device, technologies are disclosed, for instance, of causing the rotating bodies to rotate at a slower speed during the warm up of the fixing device compared to the normal speed at which the rotating bodies are caused to rotate during heat-fixing (refer to Japanese Patent Application Publication No. 2000-242126 and Japanese Patent Application Publication No. 2009-265154). By causing the rotating bodies to rotate at a comparatively slow speed during the warm up of the fixing device than during heat-fixing, the amount of heat transferring from the heating rotating body to the pressurizing rotating body during the warm up of the fixing device is reduced, and accordingly, the temperature of the heating rotating body rises at an accelerated rate. As a result, the amount of time required for the surface temperature of the heating rotating body to reach the target temperature is reduced, and accordingly, the amount of time required to warm up the fixing device is reduced.

However, according to the technology disclosed in Japanese Patent Application Publication No. 2000-242126, the warm up of the fixing device is performed while causing the rotating bodies to rotate at a slower speed compared to the normal speed at which the rotating bodies are caused to rotate during heat-fixing. Therefore, when the ambient temperature of the fixing device is low upon commencement of the warm up of the fixing device, there is a risk of the temperature of the heating rotating body reaching the target temperature before the transfer of heat from the heating rotating body to the pressurizing rotating body has progressed to a desired extent (i.e., in a state where a considerable difference lies between the temperature of the heating rotating body and the temperature of the pressurizing rotating body).

If the temperature of the heating rotating body reaches the target temperature while the transfer of heat from the heating rotating body to the pressurizing rotating body has not progressed to a desired extent, a comparatively great amount of heat transfers from the heating rotating body to the pressurizing rotating body when heat-fixing is commenced while causing the rotating bodies to rotate at the normal speed following the completion of the warm up of the fixing device. The transfer of a considerable amount of heat from the heating rotating body to the pressurizing rotating body upon commencement of heat-fixing leads to a decrease in the surface temperature of the heating rotating body. This is problematic, since when the quick print processing is performed under such a situation, there is a risk of the temperature of the fixing device not reaching the fixing temperature before the first recording sheet arrives at the fixing nip of the fixing device. As such, the application of the technology disclosed in Japanese Patent Application Publication No. 2000-242126 may lead to the occurrence of fixing failure.

In addition, when the technology disclosed in Japanese Patent Application Publication No. 2009-265154 is applied, the warm up of the fixing device is performed while causing the rotating bodies to rotate at a slower speed compared to the normal speed at which the rotating bodies are caused to rotate during heat-fixing, similar as in the technology disclosed in Japanese Patent Application Publication No. 2000-242126, and further, heat-fixing is commenced before the temperature of the heating rotating body reaches the fixing temperature and while causing the rotating bodies to rotate at the low speed. Although the application of such a technology has an effect of reducing the amount of time required to warm up the fixing device, the application of this technology may lead to the occurrence of fixing failure for the same reasons as explained above in connection with the technology disclosed in Japanese Patent Application Publication No. 2000-242126. That is, according to the technology disclosed in Japanese Patent Application Publication No. 2009-265154, after the temperature of the heating rotating body has reached the fixing temperature, heat-fixing is performed while causing the rotating bodies to rotate at the normal speed. Due to this, a considerable amount of heat transfers from the heating rotating body to the pressurizing rotating body when the switching from the low speed to the normal speed is performed upon the commencement of the heat-fixing. Accordingly, the surface temperature of the heating rotating body decreases, which may lead to the occurrence of fixing failure.

SUMMARY OF THE INVENTION

In view of such problems, the present invention provides, as one aspect thereof, an image forming apparatus including a fixing device that includes a heating rotating body and a pressurizing rotating body forming a fixing nip by the pressurizing rotating body applying pressure to the heating rotating body, and commencing an image forming operation with respect to a recording sheet following a warm-up operation during which a temperature of the heating rotating body reaches a predetermined temperature that is lower than a fixing temperature, the image forming apparatus comprising: a temperature acquisition unit that acquires an index value indicating a temperature of the pressurizing rotating body upon commencement of the warm-up operation; and a control unit that is configured to when the index value is smaller than a predetermined threshold value, perform a first control of heating the heating rotating body until the temperature of the heating rotating body reaches the fixing temperature while causing the heating rotating body and the pressurizing rotating body to rotate at a first speed, and when the index value is equal to or greater than the predetermined threshold value, perform a second control of (i) heating the heating rotating body until the temperature of the heating rotating body reaches the predetermined temperature while causing the heating rotating body and the pressurizing rotating body to rotate at a second speed that is slower than the first speed and (ii) heating the heating rotating body until the temperature of the heating rotating body reaches the fixing temperature while causing the heating rotating body and the pressurizing rotating body to rotate at the first speed after the temperature of the heating rotating body reaches the predetermined temperature.

BRIEF DESCRIPTION OF THE DRAWINGS

These and other objects, advantages and features of the invention will become apparent from the following description thereof taken in conjunction with the accompanying drawings, which illustrate a specific embodiment of the invention.

In the drawings:

FIG. 11 is a diagram illustrating a specific example of a recovery temperature estimation table; and FIG. 12 illustrates a specific example of a recovery rotation speed selection table.

DESCRIPTION OF PREFERRED EMBODIMENT

In the following, description is provided on a form of implementation of an image forming apparatus pertaining to one aspect of the present invention, taking as an example a case where the image forming apparatus pertaining to one aspect of the present invention is implemented as a tandem type color digital printer (hereinafter simply referred to as a "printer").

[1] Structure of Printer

Figure 1:
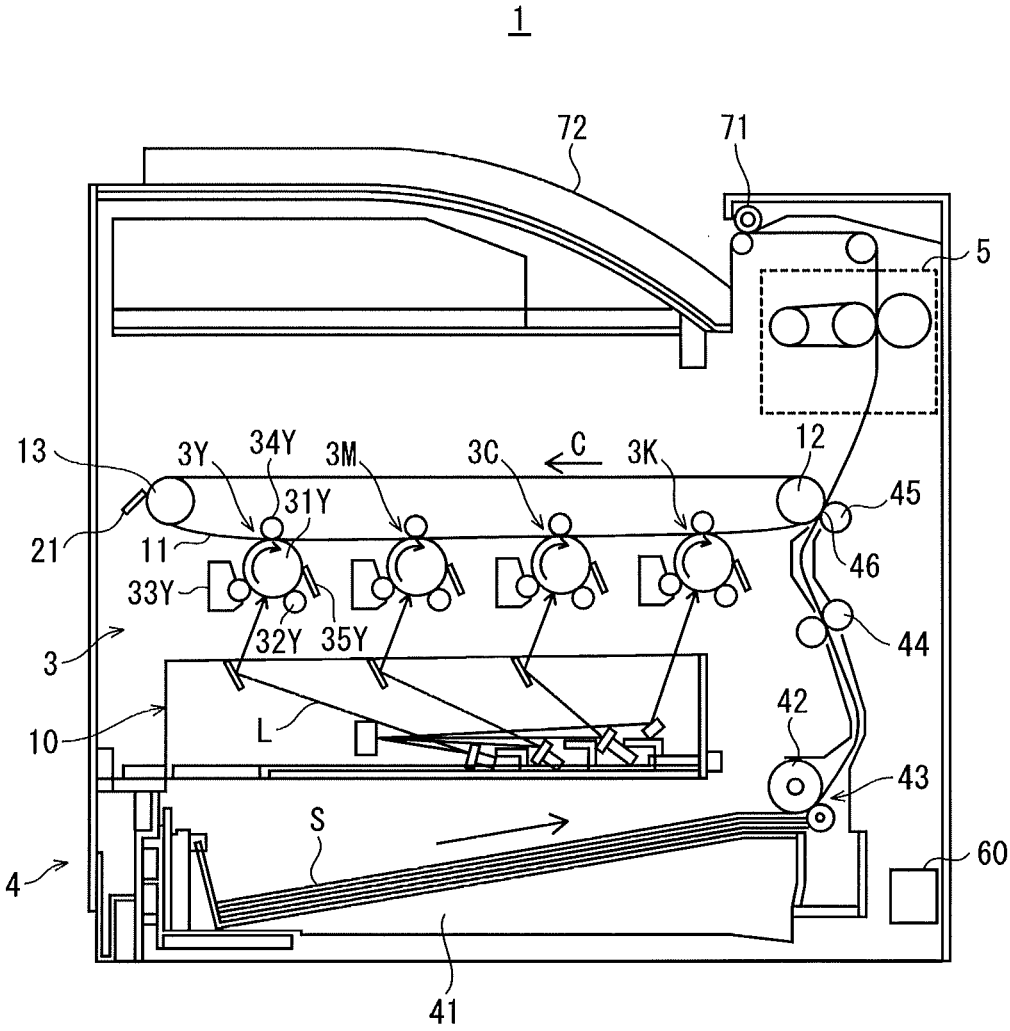
FIG. 1 illustrates a structure of a printer 1.

First, explanation is provided of a printer 1 pertaining to the present embodiment. FIG. 1 illustrates a structure of the printer 1 pertaining to the present embodiment. As illustrated in FIG. 1, the printer 1 includes: an image processor 3; a paper feeder 4; a fixing device 5; and a control unit 60. In addition, a combination of (i) the image processor 3, the paper feeder 4, and the fixing device 5, which are components of the printer 1 executing an image forming operation, and (ii) a later-described engine control unit 2, which performs communication with the control unit 60 and thereby performs control of the image forming operation, is hereinafter referred to as a "print section 9".

The printer 1 is connected to a network (e.g., a LAN). When receiving a print instruction from an external terminal device (undepicted) or an undepicted control panel that includes a display unit, the printer 1 performs print processing with respect to a recording sheet. The print processing performed by the printer unit 1 involves (i) forming toner images of the respective colors yellow, magenta, cyan, and black in accordance with the print instruction received and (ii) multiple-transferring the toner images so formed onto a recording sheet. As such, the printer 1 forms a full color image on a recording sheet. Hereinafter, the reproduction colors of yellow, magenta, cyan, and black are respectively abbreviated as Y, M, C, and K, and a corresponding one of the letters Y, M, C, and K will be appended to a reference number of a component related to a given reproduction color.

The image processor 3 includes: imaging units 3Y, 3M, 3C, and 3K; an exposure unit 10; an intermediate transfer belt 11; and a secondary transfer roller 45. Since the imaging units 3Y, 3M, 3C, and 3K have similar structures, explanation is provided in the following while mainly focusing on the imaging unit 3Y.

The imaging unit 3Y includes: a photosensitive drum 31Y; a charger 32Y; a developer 33Y; and a cleaner 35Y, and forms a toner image of the color Y on the photosensitive drum 31Y. The charger 32Y, the developer 33Y, the first transfer roller 34Y, and the cleaner 35Y are disposed in the circumference of the photosensitive drum. The cleaner 35Y is provided for cleaning the photosensitive drum 31Y. The developer 33Y is disposed so as to face the photosensitive drum 31Y and conveys electrically-charged toner to the photosensitive drum 31Y. The intermediate transfer belt 11 is an endless belt that is suspended in a tensioned state on a driving roller 12 and a driven roller 13 and is driven to rotate in a direction indicated by an arrow C in FIG. 1. In addition, a cleaner 21 for removing residual toner remaining on the intermediate transfer belt 11 is arranged in the vicinity of the driven roller 13.

The exposure unit 10 includes light-emitting elements such as laser diode elements. Upon receiving a drive signal from the control unit 60, the exposure unit 10 emits laser beams L for forming images of the colors Y, M, C, and K and exposure-scans the photosensitive drums of the imaging units 3Y, 3M, 3C, and 3K. Since the photosensitive drum 31Y, for example, is electrically-charged by the charger 32Y, an electrostatic latent image is formed on the photosensitive drum 32Y as a result of the exposure-scanning by the exposure unit 10. Similarly, an electrostatic latent image is formed on each of the respective photosensitive drums of the imaging units 3M, 3C, and 3K as a result of the exposure-scanning by the exposure unit 10.

An electrostatic latent image formed on a given one of the photosensitive drums is developed by the developer of the corresponding one of the imaging units 3Y, 3M, 3C, and 3K. As a result, a toner image of a corresponding color is formed on each of the photosensitive drums. The toner images formed on the photosensitive drums as explained above are transferred onto the intermediate transfer belt 11 one-by-one at different timings, such that the toner images overlap each other at the same position on the intermediate transfer belt 11 (primary transfer). In specific, the primary transfer of a toner image of a given color onto the intermediate transfer belt is performed by a primary transfer roller provided to the corresponding one of the imaging units 3Y, 3M, 3C, and 3K (note that in FIG. 1, the reference sign 34Y is appended to the primary transfer roller corresponding to the imaging unit 3Y, whereas reference signs for the other primary transfer rollers corresponding to the imaging units 3M, 3C, and 3K are omitted). Following the primary transfer of the toner images onto the intermediate transfer belt 11, the toner images on the intermediate transfer belt 11 are collectively transferred onto a recording sheet by electrostatic force acting on the secondary transfer roller 45 (secondary transfer).

Subsequently, the recording sheet onto which the toner images have been secondary-transferred is further conveyed to the fixing device 5, where the toner images (unfixed image) on the recording sheet are heat-fixed onto the recording sheet by the application of heat and pressure. After the heat-fixing by the fixing device 5 is completed, the recording sheet having an image fixed thereon is discharged onto a discharge tray 72 by a discharge roller 71.

The paper feeder 4 includes: a paper feed cassette 21 that contains recording sheets (indicated by reference sign S in FIG. 1); a feed roller 42 that feeds the recording sheets contained in the paper feed cassette 21 one by one onto a conveyance path 43; and a timing roller 44 for transporting recording sheets to the secondary transfer roller 44 while adjusting the timing at which the fed sheets are sent out to the secondary transfer position 36.

Here, note that the number of paper feed cassettes provided to the printer 1 is not limited to one, and a plurality of paper feed cassettes may be provided to the printer 1. In addition, paper (plain paper, thick paper, etc.) having different sizes and thicknesses and film sheets such as OHP sheets may be used as the recording sheets in the printer 1. Further, when a plurality of paper feed cassettes are provided to the printer 1, recording sheets differing in size, thickness, and material may each be accommodated in a different one of the paper feed cassettes.

The timing at which the timing roller 44 transports a recording sheet to the secondary transfer position 46 corresponds to a timing when toner images, which have been primarily-transferred onto the intermediate transfer belt 11 so as to overlap each other at the same position on the intermediate transfer belt 11, are transported to the secondary transfer position 46. By a recording sheet being transported to the secondary transfer position 46 at such a timing, the toner images on the intermediate transfer belt 11 are collectively transferred onto the recording sheet by the secondary transfer roller 45 (secondary transfer).

Here, note that each of the rollers, such as the feed roller 42 and the timing roller 44, is driven to rotate by a power source, or in specific, a conveyance motor (undepicted). In specific, drive force from the conveyance motor is applied to each of the rollers via a power transmission mechanism (undepicted) such as a gear or a belt. The conveyance motor may be, for example, a stepping motor which can control the speed at which the rollers rotate with a high degree of accuracy.

[2] Structure of Fixing Device

Figure 2:
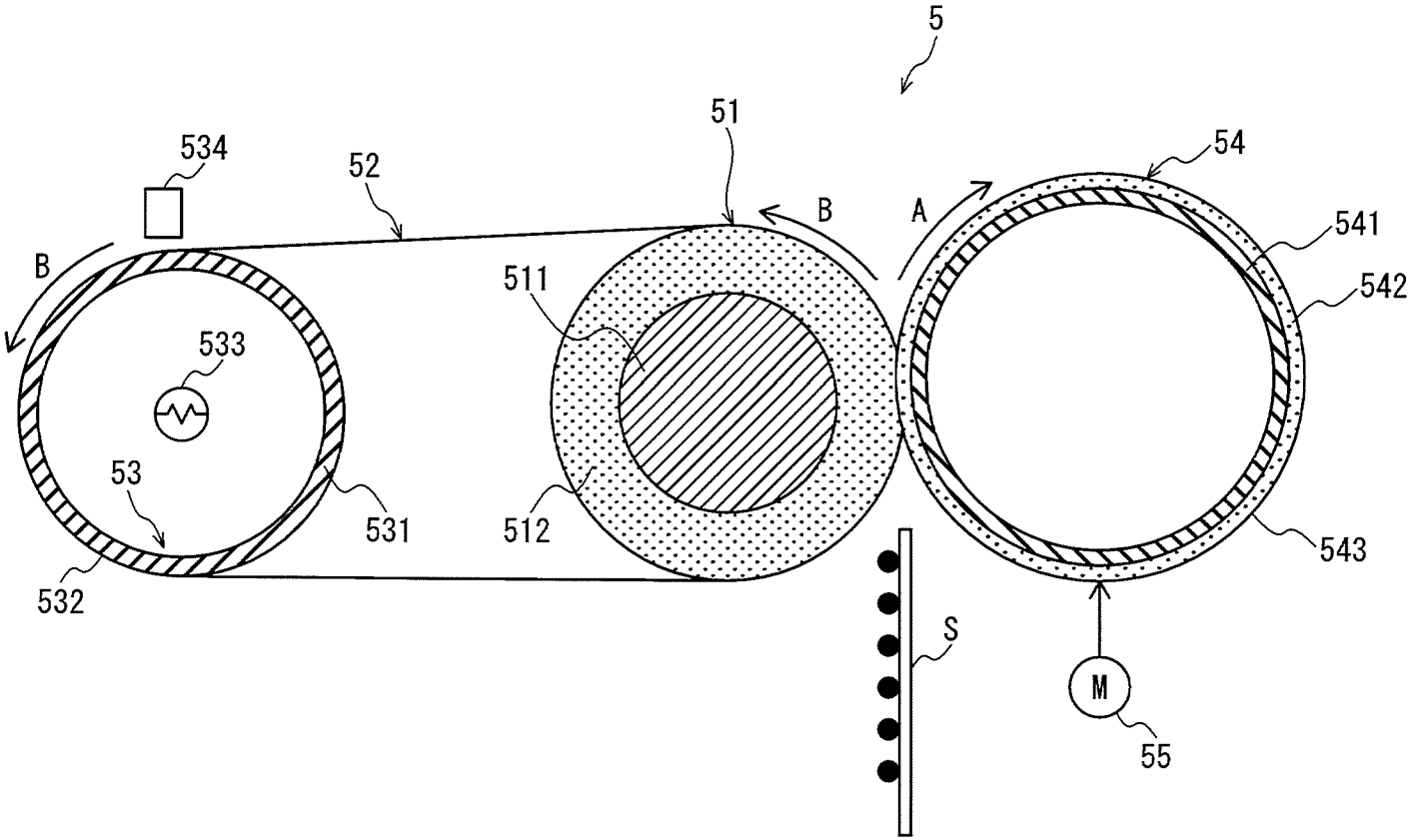
FIG. 2 is a cross-sectional view illustrating a structure of a fixing device 5.

Subsequently, explanation is provided of a structure of the fixing device 5. FIG. 2 is a cross-sectional view illustrating the structure of the fixing device 5. The reference sign S in FIG. 2 indicates a recording sheet having an unfixed image formed thereon. As illustrated in FIG. 2, the fixing device 5 includes: a fixing roller 51; a heating roller 53; a heating belt 52; and a pressurizing roller 54. The heating belt 52 is suspended in a tensioned state on the fixing roller 51 and the heating roller 53. The pressurizing roller 54 applies pressure to the fixing roller 51 via the heating belt 52 and thereby forms a fixing nip.

The pressurizing roller 54 is driven to rotate in the direction indicated by an arrow A in FIG. 2 by a pressurizing roller drive motor 55. Due to this, the fixing roller 51, the heating belt 52, and the heating roller 53 are caused to passively rotate in the direction indicated by an arrow B in FIG. 2. In specific, the control unit 60 controls the drive of the pressurizing roller drive motor 55 and thereby controls the speed at which the pressurizing roller 54 rotates.

A temperature sensor 534 for detecting the temperature of the heating belt 52 is arranged in a vicinity of the heating belt 52. The control unit 60 controls the temperature of the heating roller 53 (i.e., controls the temperature of the heating roller 53 by controlling the on/off of a later-described heater 533) in accordance with the temperature detected by the temperature sensor 534 such that the temperature of the heating belt 52 equals a predetermined temperature (for instance, 170° C.).

The fixing roller 51 is formed by coating an outer circumferential surface of a cylindrical core bar 511 composed of metal by using an elastic layer 512. For instance, the fixing roller 51 may be formed as a roller having an outer diameter of 20-50 mm by forming an elastic layer 512 having a thickness of 2-10 mm on an outer circumferential surface of a columnar core bar 511 having a thickness of 2-5 mm. As for the metal for composing the core bar 511, metals such as Al, Fe, and SUS (Stainless Used Steel) may be used. Further, an elastic body composed of silicone rubber, silicone sponge or the like may be used as the elastic layer 512.

Figure 3:
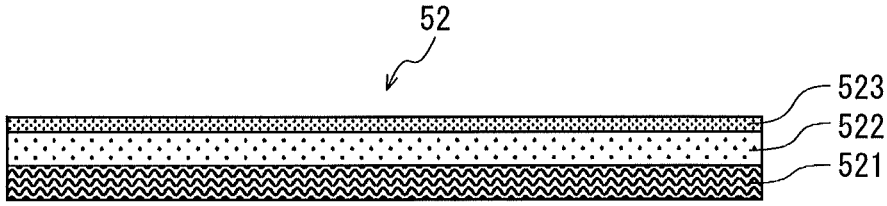
FIG. 3 is a cross-sectional view illustrating a structure of a heating belt 52.

The heating belt 52 is an endless belt that is driven to rotate. The heating belt 52 is heated by the heating roller 53, and when the fixing device 5 performs heat-fixing, the heating belt 53 comes in contact with the recording sheet S and thereby thermally-fuses the unfixed image on the recording sheet S. FIG. 3 is a cross-sectional view illustrating the structure of the heating belt 52. The heating belt 52 includes a base layer 521, an elastic layer 522, and a releasing layer 523 laminated in the stated order. For instance, the heating belt 52 used in the printer 1 may have an outer diameter of 60-120 mm and may include: a base layer 521 having a thickness of 40-150 μm; an elastic layer 522 having a thickness of 100-300 μm; and a releasing layer 523 having a thickness of 30-50 μm.

As for the material for forming the base layer 521, metals such as Ni or heat-resistant resins such as polyimide and polyamide may be used. As for the material for forming the elastic layer 522, a heat-resistant elastic material such as silicone rubber may be used. As for the material for forming the releasing layer 523, fluororesins such as PFA (tetrafluoroethylene perfluoroalkoxy ethylene copolymer), PTFE (tetrafluoroethylene), FEP (tetrafluoroethylene hexafluoroethylene copolymer), and PFEP (tetrafluoroethylene hexafluoropropylene copolymer) may be used.

Returning to the explanation referring to FIG. 2, the heating roller 53 includes a core bar 531 and a coating layer 532. The core bar 531 is a hollow cylinder composed of metal, and the heater 533 is disposed in an internal space (hollow portion) of the core bar 531. The coating layer 532 coats the outer circumferential surface of the core bar 531. For instance, the heating roller 53 may be a roller having an outer diameter of approximately 25 mm (including a core bar 531 having a thickness of approximately 1 mm and a coating layer 532 having a thickness of approximately 20 μm). As for the metal for composing the core bar 531, metals such as Al, Fe, and SUS (Stainless Used Steel) may be used. The coating layer 532 is provided so as to prevent degradation of the heating roller 53 caused by frictional wear resulting from friction with the heating belt 52, and has the same functions as the commonly-known Teflon® coating. As for the material for composing the coating layer 532, PTFE may be used, for instance. The heater 533 may be, for instance, a halogen heater lamp having a wattage of 999 W and a light emission length of 290 mm.

The pressurizing roller 54 includes a core bar 541, an elastic layer 542, and a releasing layer 543. The core bar 541 is a hollow cylinder composed of metal, the elastic layer 542 coats the outer circumferential surface of the core bar 541, and the releasing layer 543 coats the outer circumferential surface of the elastic layer 542. For instance, the pressurizing roller 54 may be a roller having an outer diameter of 35 mm (including a core bar 541 having a thickness of 2 mm, an elastic layer 542 having a thickness of 4 mm, and a releasing layer 543 having a thickness of approximately 30 μm).

As for the metal for composing the core bar 541, metals such as Al, Fe, and SUS (Stainless Used Steel) may be used. As for the material for forming the elastic layer 542, an elastic material such as silicone rubber, silicone sponge, fluororubber or the like may be used. As for the material for composing the releasing layer 543, the same material as used for forming the releasing layer 523 of the heating belt 52 may be used.

Although undepicted in FIG. 2, the fixing device 5 is provided with a frame that supports the longitudinal ends of each of the fixing roller 51, the heating roller 53, and the pressurizing roller 54 and that covers such components of the fixing device 5. In addition, the above-described frame of the fixing device 5 has openings provided thereto as necessary. In particular, openings are provided to the frame at positions corresponding to (i) positions at which recording sheets enter/exit the fixing device 5 and (ii) the vicinity of the positions at which the frame supports the longitudinal ends of the fixing roller 51, the heating roller 53, and the pressurizing roller 54.

[3] Structure of Control Unit

Figure 4:
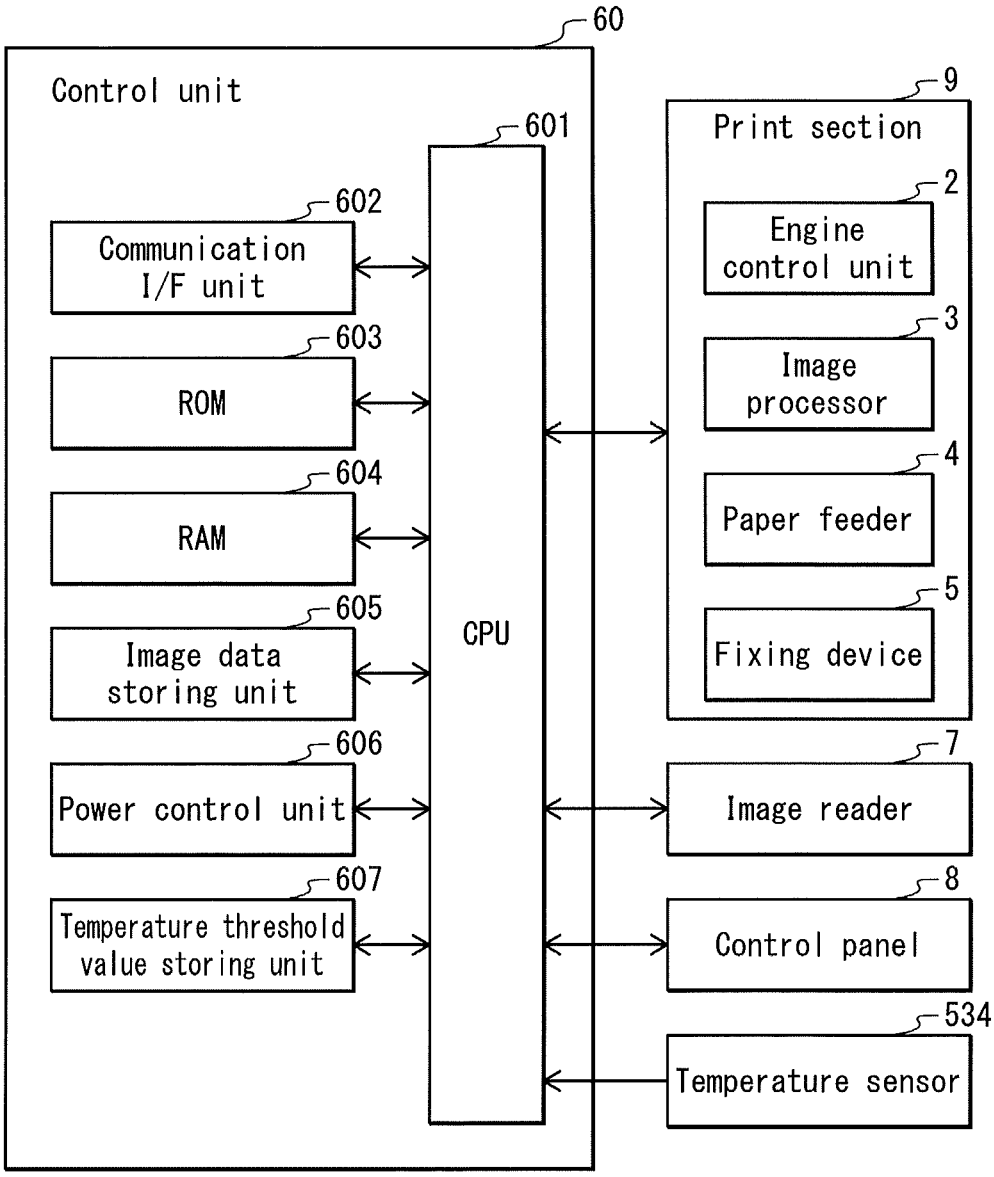
FIG. 4 illustrates a structure of a control unit 60 and a relation between the structure of the control unit 60 and main components that are controlled by the control unit 60.

FIG. 4 illustrates a structure of a control unit 60 and a relation between the structure of the control unit 60 and the main components that are controlled by the control unit 60. The control unit 60 is a so-called computer and includes: a CPU (Central Processing Unit) 601; a communication interface (I/F) unit 602; a ROM (Read Only Memory) 603; a RAM (Random Access Memory) 604; an image data storing unit 605; a power control unit 606; and a temperature threshold value storing unit 607, as illustrated in FIG. 4.

The communication I/F unit 602 is an interface, such as a LAN card and a LAN board, for connecting with a LAN. The ROM 603 stores therein programs for controlling the print section 9, an image reader 7, a control panel 8, the temperature sensor 534 and the like, a program for controlling a later-described rotation speed control processing, etc.

The RAM 604 is a work area that is used by the CPU 601 when the CPU 601 executes a program. The image data storing unit 605 stores image data input thereto via the communication I/F unit 602 and the image reader 7. The image data stored by the image data storing unit 605 is used for print processing. The power control unit 606 switches on and off the application of electricity to a later-described power unit 700, and thereby performs control of switching on and off the supply of power to the print section 9.

The CPU 601 controls the print section 9, the image reader 7, the control panel 8, the temperature sensor 534, and the like by executing various programs stored onto the ROM 630. In addition, the CPU 601 controls the operations involved in the later-described rotation speed control processing.

Figure 5:
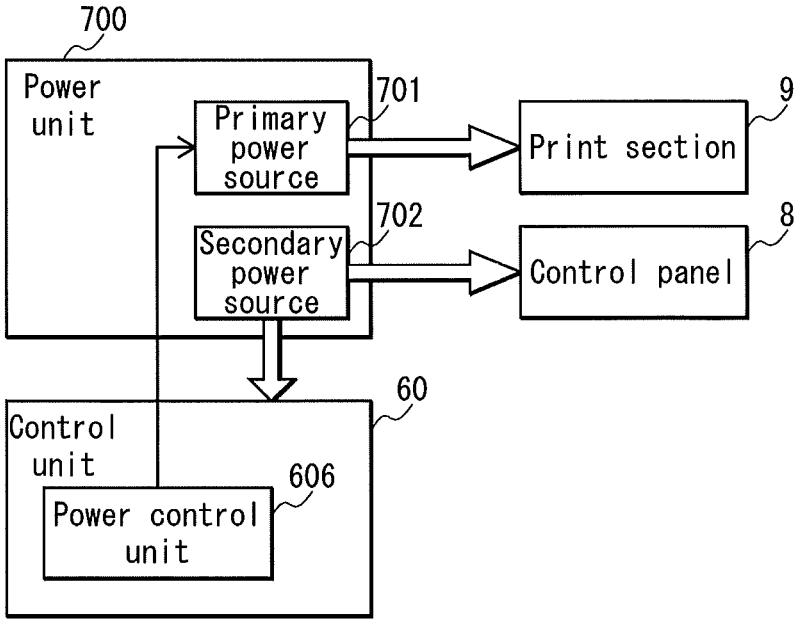
FIG. 5 illustrates a structure of a power unit 700 and a relation between the structure of the power unit 700 and main components to which the power unit 700 supplies power.

FIG. 5 illustrates a structure of the power unit 700 and a relation between the structure of the power unit 700 and main components to which the power unit 700 supplies power. As illustrated in FIG. 5, the power unit 700 includes a primary power source 701 and a secondary power source 702. The primary power source 701 is connected with the print section 9, and the secondary power source 702 is connected with the control panel 8 and the control unit 60, as illustrated in FIG. 5.

The power control unit 606 switches on and off the application of electricity to the primary power source 701, and thereby performs control of switching on and off the supply of power to the print section 9. On the other hand, the secondary power source 702 supplies power to the control unit 60 and the control panel 7.

Returning to the explanation referring to FIG. 4, the temperature threshold value storing unit 607 stores therein (i) a temperature threshold value, (ii) a print-executable temperature, and (iii) a fixing speed table. The "temperature threshold value" refers to a threshold value for the temperature of the pressurizing roller 54 at the point when the fixing device 5 recovers from a sleep state thereof. More specifically, the temperature threshold value is a threshold value that is used in the later-described rotation speed control processing, and is used as the threshold for determining whether to select, as the speed at which the pressurizing roller 54 is caused to rotate when a warm-up operation of the fixing device 5 is commenced, a normal speed or a low speed. The "normal speed" refers to a speed at which the pressurizing roller 54 is normally caused to rotate, whereas the "low speed" refers to a speed that is slower than the normal speed.

In the present embodiment, the temperature detected by the temperature sensor 534 is used as an index value for indicating the temperature of the pressurizing roller 54 upon the recovery of the fixing device 5 from the sleep state (hereinafter simply referred to as "recovery from the sleep state"). However, the index value may be detected by separately providing a temperature sensor for detecting the temperature of the pressurizing roller 54.

In addition, the "normal speed" refers to a rotation speed of the pressurizing roller 54 of the fixing device 5 that is applied during the execution of a print job. More specifically, the "normal speed" refers to a rotation speed of the pressurizing roller 54 applied when heat-fixing is performed after the temperature of the heating belt 52 has reached a fixing temperature. On the other hand, the "low speed" refers to a rotation speed of the pressurizing roller 54 that is applied during the warm-up operation of the fixing device 5. Here, it is presumed that the low speed is ⅓ the speed of the normal speed.

Further, "the warm-up operation" refers to an operation performed before the print section 9 performs the image forming operation and during which the heating roller 53 is heated until a temperature of the fixing device 5 (i.e., the heating belt 52) reaches a predetermined temperature (i.e., a later-described print-executable temperature in the present embodiment).

The above-described "temperature threshold value" is set to a minimum value of the index value indicating the temperature of the pressurizing roller 54 upon recovery from the sleep state (referred to hereinafter as a "recovery temperature"). That is, when the recovery temperature of the pressurizing roller 54 is higher than or equal to the minimum value, the temperature of the heating belt 52 is able to reach the fixing temperature before a leading edge of a first recording sheet introduced to the fixing device 5 reaches the fixing nip when the image forming operation with respect to the first recording sheet is commenced. Here, the image forming operation with respect to the first recording sheet is commenced when the temperature of the heating belt 52 reaches the print-executable temperature as a result of a later-described rotation heating processing. The "rotation heating processing" refers to processing involving: (i) heating the heating belt 52 via the heating roller 53 such that the temperature of the heating belt 52 reaches the print-executable temperature while causing the pressurizing roller 54 to rotate at the low speed upon recovery from the sleep state (i.e., a power-saving state of the fixing device 5 where the supply of power from the power unit 700 to the print section 9 (including the fixing device 5) is suspended and during which the execution of the image forming operation is disabled) and (ii) further heating the heating belt 52 until the temperature of the heating belt 52 reaches the fixing temperature while causing the fixing roller 51 to rotate at the normal speed after the temperature of the heating belt 52 has reached the print-executable temperature. Here, note that the print-executable temperature is a lower temperature than the fixing temperature. In addition, the temperature threshold value is preemptively set as described above by the manufacturer of the printer 1 according to results of experiments conducted using the printer 1. Further, the "temperature threshold value" is not limited to being exactly equal to the above-described minimum value, and may be set to any temperature provided that the temperature threshold value is set to be equal to or higher than the minimum value.

The aforementioned "print-executable temperature" refers to a temperature of the heating belt 52 and is such that, when the image forming operation with respect to the first recording sheet is commenced after the temperature of the heating belt 52 reaches the print-executable temperature, it can be expected that the temperature of the heating belt 52 reaches the fixing temperature before the leading edge of the first recording sheet reaches the fixing nip. The print-executable temperature is preemptively set by the manufacturer of the printer 1. Note that in the following, explanation is provided under the presumption that the fixing temperature is set to 170° C. and the print-executable temperature is set to 150° C.

When the rotation heating processing as described above is performed, the amount of heat transferring from the heating side (the heating belt 52) to the pressurizing roller 54 after the pressurizing roller 54 switches from rotating at the low speed to rotating at the normal speed can be determined according to the difference between the temperature of the heating side and the temperature of the pressurizing roller 54 at the point when the pressurizing roller 54 switches from rotating at the low speed to rotating at the normal speed (Fourier's law). Here, the heating side and the pressurizing roller 54 are in a pressure contact state where the pressurizing roller 54 contacts and applies pressure to the heating side.

Further, the difference between the temperature of the heating side and the temperature of the pressurizing roller 54 at the point when the pressurizing roller 54 switches from rotating at the low speed to rotating at the normal speed is influenced by the recovery temperature of the pressurizing roller 54. In specific, when the recovery temperature of the pressurizing roller 54 is comparatively low, the difference between the temperatures of the heating side and the pressurizing roller 54 is comparatively great. In such a case, a comparatively great amount of heat transfers from the heating side to the pressurizing roller 54 at the point when the pressurizing roller 54 switches from rotating at the low speed to rotating at the normal speed. Hence, when the recovery temperature of the pressurizing roller 54 is comparatively low, the temperature of the heating belt 53 cannot reach the fixing temperature before the leading edge of the first recording sheet reaches the fixing nip when the image forming operation with respect to the first recording sheet is commenced. Hence, it is very likely that fixation failure will occur.

In order so as to avoid such a situation, a temperature threshold value for the recovery temperature of the pressurizing roller 54 is preemptively set in the present embodiment. In addition, arrangement is made such that, when the recovery temperature is lower than the temperature threshold value, the initial speed at which the pressurizing roller 54 is caused to rotate upon recovery from the sleep state is set to the normal speed. By making such an arrangement, the increase in the amount of heat transferring from the heating side to the pressurizing roller 54 due to the speed at which the pressurizing roller 54 rotates being switched can be prevented. Accordingly, the occurrence of fixing failure can be inhibited.

The "fixing speed table" refers to a table indicating the speed to be selected as the speed for causing the pressurizing roller 54 to rotate in each of (i) a case where the recovery temperature of the pressurizing roller 54 is higher than or equal to the temperature threshold value and (ii) a case where the recovery temperature of the pressurizing roller 54 is lower than the temperature threshold value. In the following, explanation is provided under the presumption that the fixing speed table indicates the "low speed" (⅓ the speed of the "normal speed") as the speed at which the pressurizing roller 54 is to be caused to rotate in the former case where the recovery temperature of the pressurizing roller 54 is higher than or equal to the temperature threshold value, whereas the fixing speed table indicates the "normal speed" as the speed at which the pressurizing roller 54 is to be caused to rotate in the latter case where the recovery temperature of the pressurizing roller 54 is lower than the temperature threshold value. Note that the speed at which the pressurizing roller 54 is to be caused to rotate in each of the cases is indicated in the fixing speed table by means of a running speed of the heating belt 52, which is caused to passively rotate as the pressurizing roller 54 rotates.

The engine control unit 2 of the print section 9 controls the operation of the image processor 3, the paper feeder 4, and the fixing device 5. Further, the control unit 60 controls the image forming operation by the print section 9 via the engine control unit 2.

The image reader 7 includes an image input device such as a scanner and the like. The image reader 7 reads information such as characters and figures printed on a recording sheet, such as a sheet of paper, and thereby forms image data.

The control panel 8 includes a plurality of input keys and a liquid crystal display unit. The liquid crystal display unit has a touch panel laminated on a surface thereof. The control panel 8 receives instructions from users and notifies the control unit 60 of such instructions. A user issues an instruction by performing touch input to the touch panel or by performing key input to the input keys

[4] Rotation Speed Control Processing

Figure 6:
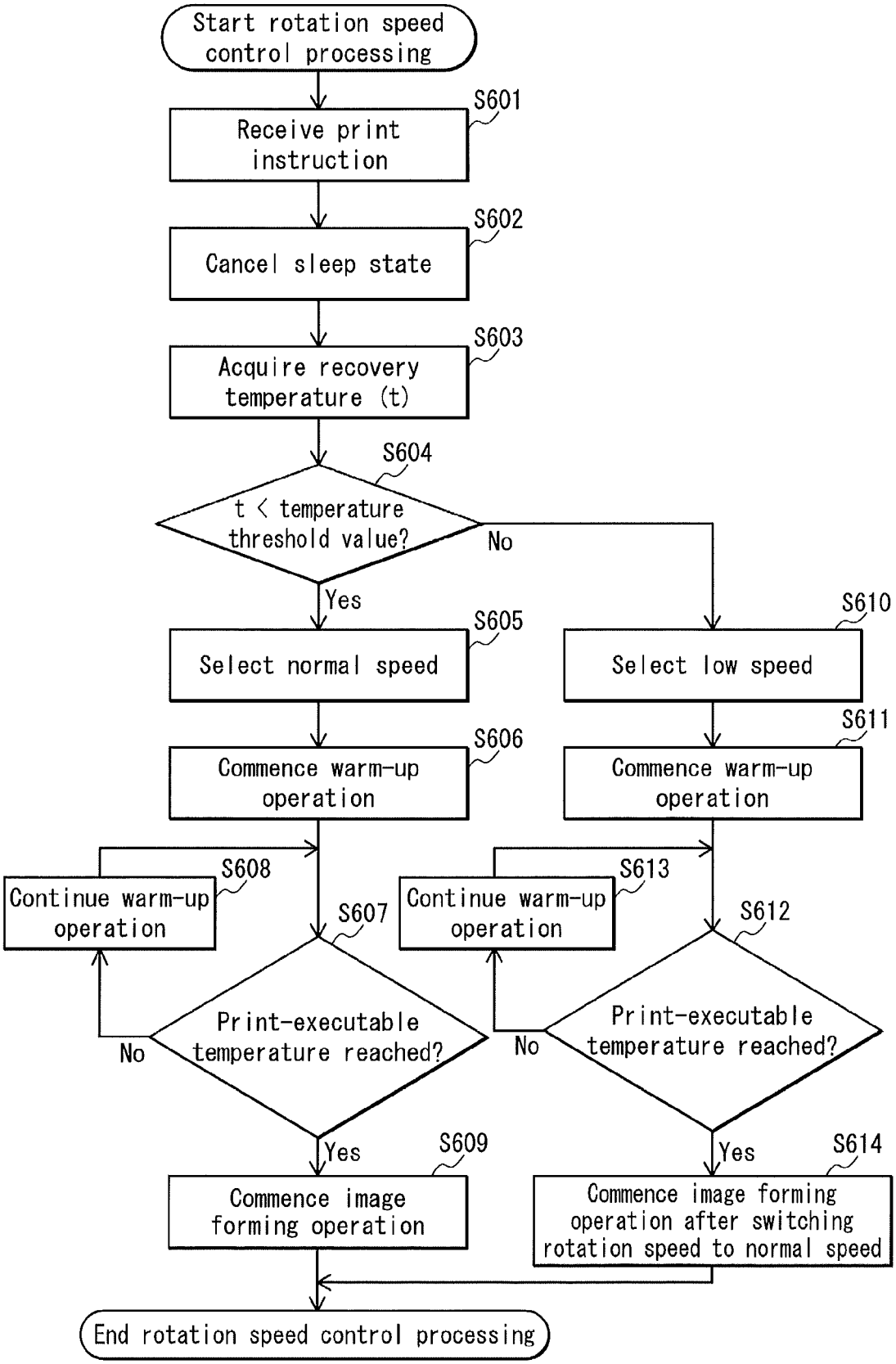
FIG. 6 is a flowchart illustrating operations involved in rotation speed control processing performed by the control unit 60.

Subsequently, explanation is provided of operations involved in the rotation speed control processing performed by the control unit 60. FIG. 6 is a flowchart illustrating the operations involved in the rotation speed control processing performed by the control unit 60.

When receiving a print instruction from the communication I/F unit 602 or the control panel 7 while the fixing device 5 is in the sleep state (Step S601), the control unit 60 commences the supply of power to the print section 9 and thereby cancels the sleep state of the fixing device 5 (Step S602). Further, the control unit 60 acquires the temperature detected by the temperature sensor 534 as the recovery temperature (t) (Step S603). As already explained above, when the fixing device 5 is in the sleep state, the supply of power from the power unit 700 to the print section 9 (including the fixing device 5) is suspended.

Subsequently, the control unit 60 judges whether or not the recovery temperature (t) is lower than the temperature threshold value stored in the temperature threshold value storing unit 607 (Step S604). When the recovery temperature (t) is lower than the temperature threshold value (Step S604: Yes), the control unit 60 refers to the fixing speed table stored in the temperature threshold value storing unit 607 and selects the normal speed as the speed at which the pressurizing roller 54 is to be caused to rotate upon commencement of the warm-up operation (Step S605). As explanation has been provided above, the normal speed is indicated in the fixing speed table as corresponding to the case where the recovery temperature of the pressurizing roller 54 is lower than the temperature threshold value.

Following this, the control unit 60 commences the warm-up operation of the fixing unit 5 by heating the heater 533 of the heating roller 53 via the engine control unit 2 and thereby heating the heating belt 52 via the heating roller 53 while causing the heating belt 52 to passively rotate by causing the pressurizing roller 54 to rotate at the selected speed via the pressurizing roller drive motor 55 (Step S606).

The control unit 60 continues to perform the warm-up operation until the detection temperature of the temperature sensor 534 (the temperature of the heating belt 52) reaches the print-executable temperature stored in the temperature threshold value storing unit 607 (Step S607: No, Step S608). When the detection temperature of the temperature sensor 534 (the temperature of the heating belt 52) reaches the print-executable temperature (Step S607: Yes), the control unit 60 causes the print section 9 to commence the image forming operation (Step S609). During the image forming operation, the control unit 60 performs control such that the temperature of the heating belt 52 rises to the fixing temperature by heating the heating roller 53 while causing the heating belt 52 to passively rotate by causing the pressurizing roller 54 to rotate at the normal speed.

When the recovery temperature of the pressurizing roller 54 is higher than or equal to the temperature threshold value in Step S604 (Step S604: No), the control unit 60 refers to the fixing speed table stored in the temperature threshold value storing unit 607 and selects the low speed as the speed at which the pressurizing roller 54 is to be caused to rotate upon commencement of the warm-up operation (Step S610). As explanation has been provided above, the low speed is indicated in the fixing speed table as corresponding to the case where the recovery temperature of the pressurizing roller 54 is higher than or equal to the temperature threshold value.

Following this, the control unit 60 commences the warm-up operation of the fixing unit 5 by heating the heater 533 of the heating roller 53 via the engine control unit 2 and thereby causing the heating belt 52 to passively rotate by causing the pressurizing roller 54 to rotate at the selected speed via the pressurizing roller drive motor 55 (Step S611). The control unit 60 continues to perform the warm-up operation until the detection temperature of the temperature sensor 534 (the temperature of the heating belt 52) reaches the print-executable temperature stored in the temperature threshold value storing unit 607 (Step S612: No, Step S613).

When the detection temperature of the temperature sensor 534 (the temperature of the heating belt 52) reaches the print-executable temperature (Step S612: Yes), the control unit 60 causes the print section 9 to commence the image forming operation after causing the pressurizing roller 54 to switch from rotating at the low speed to rotating at the normal speed via the engine control unit 2 (Step S614). During the image forming operation, the control unit 60 performs control such that the temperature of the heating belt 52 rises to the fixing temperature by heating the heating roller 53 while causing the heating belt 52 to passively rotate by causing the pressurizing roller 54 to rotate at the normal speed.

[5] Example of Implementation

FIGS. 7 through 10 illustrate results of experiments in which observation was performed of the chronological transition of the temperature of the heating belt 52 and the chronological transition of the pressurizing roller 54 following the commencement of the warm-up operation in each of (i) a case where the recovery temperature of the pressurizing roller 54 was 30° C. and (ii) a case where the recovery temperature of the pressurizing roller 54 was 45° C. Further, for each of the cases, observation was performed of (i) a case where the pressurizing roller 54 was caused to rotate at the low speed upon commencement of the warm-up operation and (ii) a case where the pressurizing roller 54 was caused to rotate at the normal speed upon commencement of the warm-up operation. In each of FIGS. 7 through 10, the reference sign P indicates the chronological transition of the temperature of the heating belt 52, and the reference sign Q indicates the chronological transition of the temperature of the pressurizing roller 54.

Figure 7:
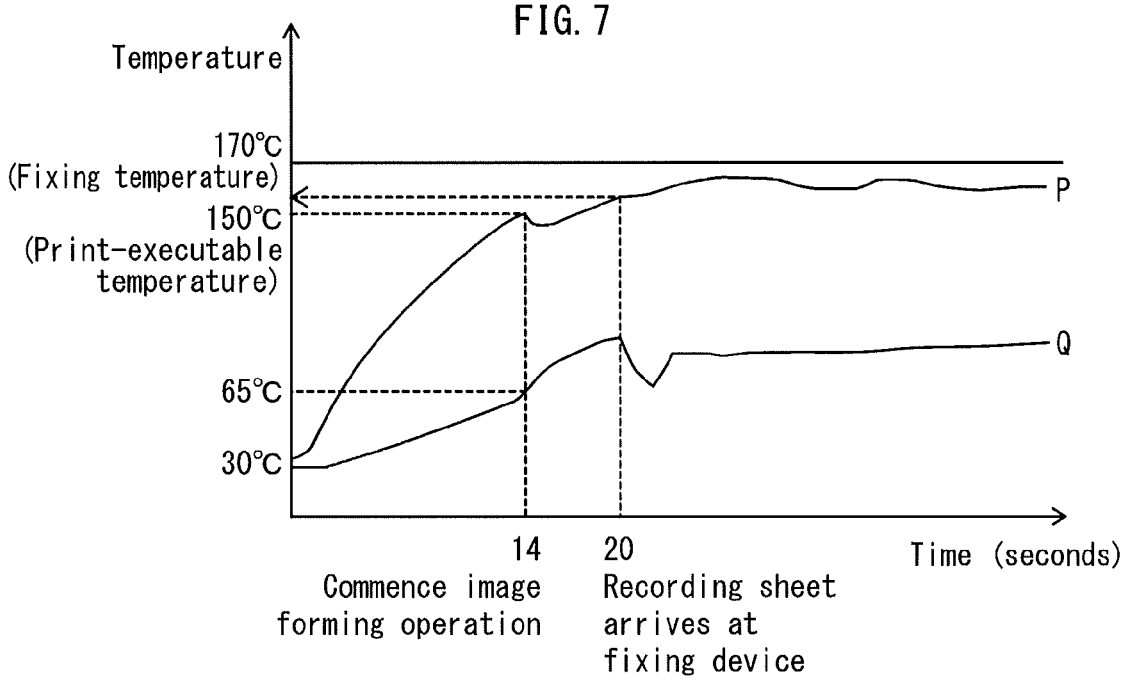
FIG. 7 illustrates a chronological transition of a temperature of the heating belt 52 and a chronological transition of a temperature of a pressurizing roller 54 following the commencement of a warm-up operation, in a case where (i) the temperature of the pressurizing roller 54 upon recovery from a sleep state was 30° C. and (ii) the pressurizing roller 54 was caused to rotate at a low speed upon commencement of the warm-up operation.
Figure 8:
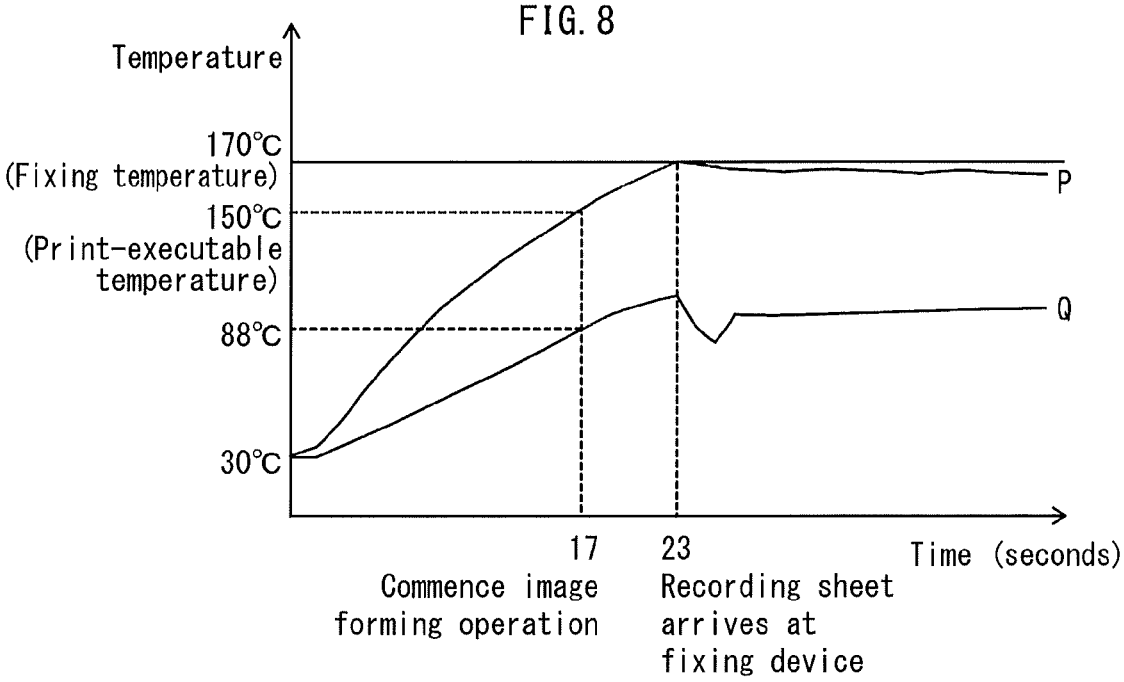
FIG. 8 illustrates the chronological transition of the temperature of the heating belt 52 and the chronological transition of the temperature of the pressurizing roller 54 following the commencement of the warm-up operation, in a case where (i) the temperature of the pressurizing roller 54 upon recovery from the sleep state was 30° C. and (ii) the pressurizing roller 54 was caused to rotate at a normal speed upon commencement of the warm-up operation.
Figure 9:
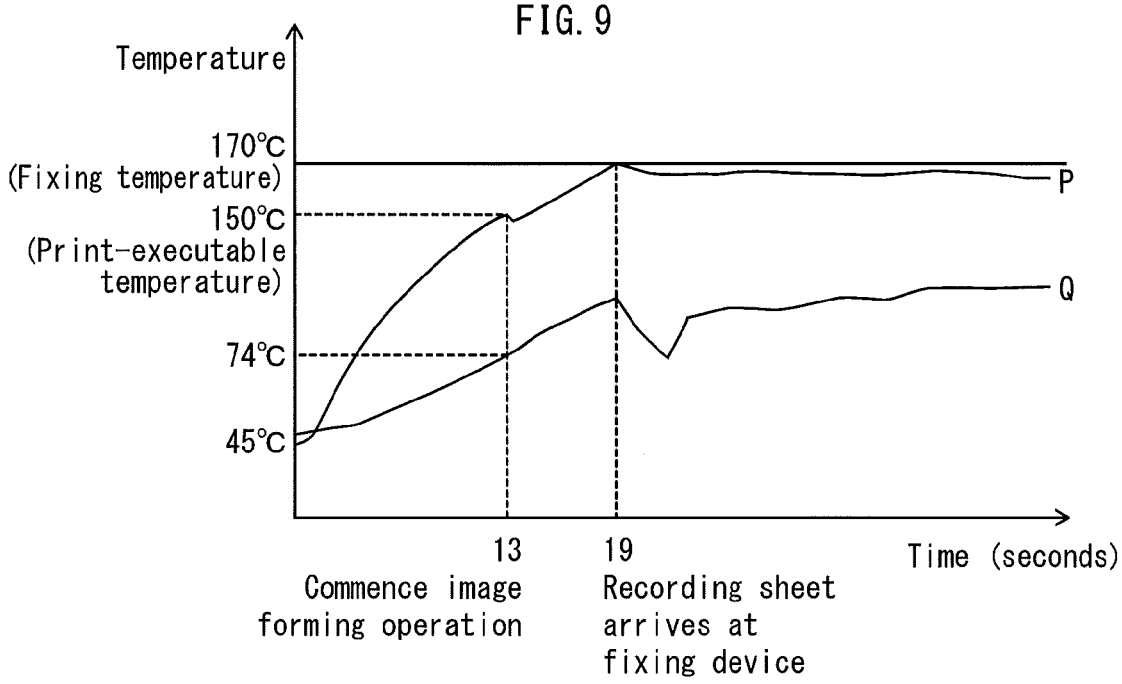
FIG. 9 illustrates the chronological transition of the temperature of the heating belt 52 and the chronological transition of the temperature of the pressurizing roller 54 following the commencement of the warm-up operation, in a case where (i) the temperature of the pressurizing roller 54 upon recovery from the sleep state was 45° C. and (ii) the pressurizing roller 54 was caused to rotate at the low speed upon commencement of the warm-up operation.
Figure 10:
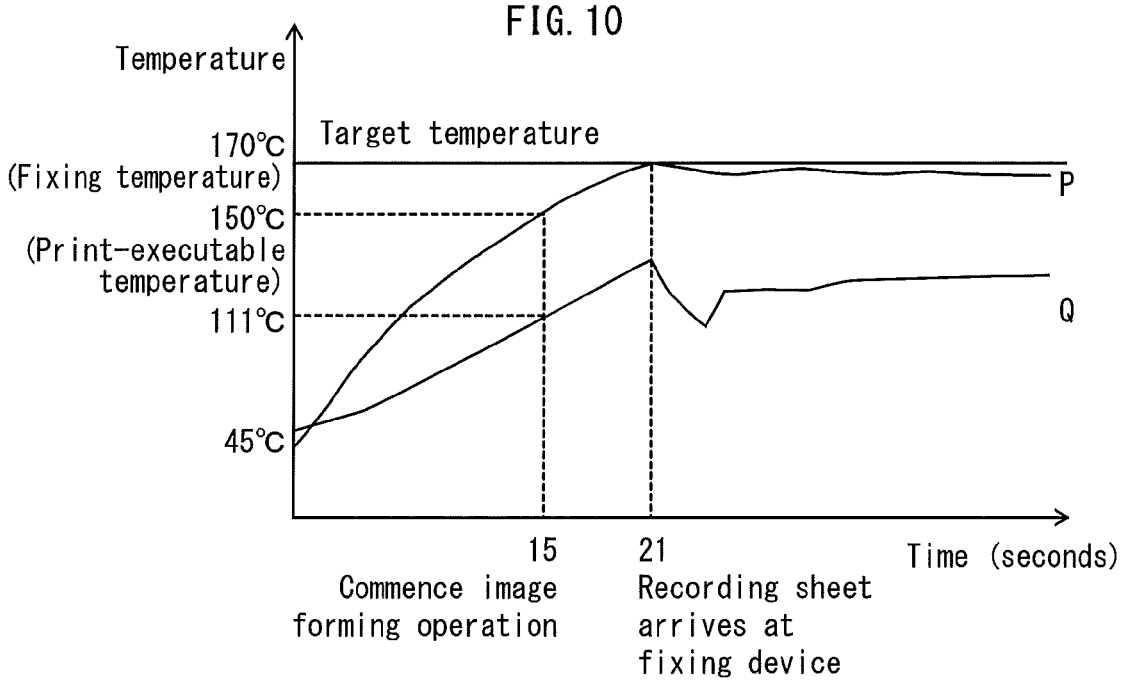
FIG. 10 illustrates the chronological transition of the temperature of the heating belt 52 and the chronological transition of the temperature of the pressurizing roller 54 following the commencement of the warm-up operation, in a case where (i) the temperature of the pressurizing roller 54 upon recovery from the sleep state was 45° C. and (ii) the pressurizing roller 54 was caused to rotate at the normal speed upon commencement of the warm-up operation.

FIG. 7 illustrates the chronological transition of the temperature of the heating belt 52 and the chronological transition of the temperature of the pressurizing roller 54 following the commencement of the warm-up operation, in a case where (i) the recovery temperature of the pressurizing roller 54 was 30° C. and (ii) the pressurizing roller 54 was caused to rotate at the low speed upon commencement of the warm-up operation. FIG. 8 illustrates the chronological transition of the temperature of the heating belt 52 and the chronological transition of the temperature of the pressurizing roller 54 following the commencement of the warm-up operation, in a case where (i) the recovery temperature of the pressurizing roller 54 was 30° C. and (ii) the pressurizing roller 54 was caused to rotate at the normal speed upon commencement of the warm-up operation. FIG. 9 illustrates the chronological transition of the temperature of the heating belt 52 and the chronological transition of the temperature of the pressurizing roller 54 following the commencement of the warm-up operation, in a case where (i) the recovery temperature of the pressurizing roller 54 was 45° C. and (ii) the pressurizing roller 54 was caused to rotate at the low speed upon commencement of the warm-up operation. FIG. 10 illustrates the chronological transition of the temperature of the heating belt 52 and the chronological transition of the temperature of the pressurizing roller 54 following the commencement of the warm-up operation, in a case where (i) the recovery temperature of the pressurizing roller 54 was 45° C. and (ii) the pressurizing roller 54 was caused to rotate at the normal speed upon commencement of the warm-up operation. The following describes the structure of the fixing device 5 used in the experiments illustrated in FIGS. 7 through 10 and the conditions under which the experiments illustrated in FIGS. 7 through 10 were conducted.

1. Fixing Roller 51

As the fixing roller 51, a roller having an outer diameter of 30 mm and composed of a solid core bar 511 and an elastic layer 512 was used. The core bar 511 was composed of Fe and had an outer diameter of 18 mm, and the elastic layer 512 was composed of silicone rubber having a thickness of 4 mm and sponge having a thickness of 2 mm.

2. Heating Belt 52

As the heating belt 52, a belt having an outer diameter of 60 mm and composed of a base layer 521, an elastic layer 522, and a releasing layer 523 was used. The base layer 521 was composed of polyimide and had a thickness of 70 μm, the elastic layer 522 was composed of silicone rubber and had a thickness of 200 μm, and the releasing layer 523 was composed of PFA and had a thickness of 30 μm.

3. Heating Roller 53

As the heating roller 53, a roller having an outer diameter of 25 mm and a length (longitudinal length) of approximately 330 mm, and composed of a core bar 531 and a coating layer 532 was used. The core bar 531 was a hollow cylinder composed of Al and had a thickness of 0.6 mm. Further, the core bar 531 had a halogen heater (the heater 533) having a wattage of 999 W and a light emission length of 290 mm disposed therein. The coating layer 532 was composed of PTFE and had a thickness of 15 μm.

4. Pressurizing Roller 54

As the pressurizing roller 54, a roller having an outer diameter of 35 mm and composed of a core bar 541, an elastic later 542, and a releasing layer 543 was used. The core bar 541 was a hollow cylinder composed of Al and had a thickness of 2 mm, the elastic layer 542 was composed of silicone rubber and had a thickness of 2 mm, and the releasing layer 543 was composed of PFA and had a thickness of 30 μm.

5. Rotation Speed of Pressurizing Roller 54

The normal speed applied to the rotation of the pressurizing roller 54 was set to a speed corresponding to a running speed of 210 mm/s of the heating belt 52, and the low speed applied to the rotation of the pressurizing roller 54 was set to a speed corresponding to a running speed of 70 mm/s of the heating belt 52.

In addition, thermopiles were used as temperature sensors in the experiments. The temperature sensors were disposed at an axial-direction center portion of the heating belt 52 and at an axial-direction center portion of the pressurizing roller 54 with an interval of 40 mm therebetween.

6. Fixing Temperature and Print-executable Temperature employed in Experiments

In the experiments, the fixing temperature of the heating belt 52 was set to 170° C., and the print-executable temperature of the heating belt 52 was set to 150° C.

7. Control of Rotation Speed of Pressurizing Roller 54

Similar as in the rotation speed control processing explained referring to FIG. 6, in cases where the warm-up operation was commenced while causing the pressurizing roller 54 to rotate at the low speed, the pressurizing roller was caused to rotate at the low speed during the warm-up operation until the temperature of the heating belt 52 reached the print-executable temperature and subsequently, the pressurizing roller 54 was caused to switch from rotating at the low speed to rotating at the normal speed when the temperature of the heating belt 52 reached the print-executable temperature. In contrast, in cases where the warm-up operation was commenced while causing the pressurizing roller 54 to rotate at the normal speed, the speed at which the pressurizing roller 54 was caused to rotate was maintained at the normal speed from the commencement of the warm-up operation.

In addition, similar as in the rotation speed control processing explained with reference to FIG. 6, the image forming operation by the print section 9 was commenced at the point when the temperature of the fixing device 5 reached the print-executable temperature. Further, the image forming operation by the print section 9 was performed by using full color toner for forming toner images of the colors Y, M, C, and K.

In the following, comparison is made of the experiment results illustrated in FIGS. 7 and 9. In the case illustrated in FIG. 7, where (i) the pressurizing roller 54 was caused to rotate at the low speed upon commencement of the warm-up operation and (ii) the recovery temperature of the pressurizing roller 54 was 30° C., the difference between the temperature of the heating belt 52 and the temperature of the pressurizing roller 54 (65° C.) at the point when the temperature of the heating belt 52 reached the print-executable temperature (150° C.) (the point when the image forming operation was commenced) was 85° C. In contrast, in the case illustrated in FIG. 9, where (i) the pressurizing roller 54 was caused to rotate at the low speed upon commencement of the warm-up operation and (ii) the recovery temperature of the pressurizing roller 54 was 45° C., the difference between the temperature of the heating belt 52 and the temperature of the pressurizing roller 54 (74° C.) at the point when the temperature of the heating belt 52 reached the print-executable temperature (150° C.) was 76° C. Hence, the difference between the temperatures in the case illustrated in FIG. 7 was greater than the difference between the temperatures in the case illustrated in FIG. 9 by nearly 10° C. (9° C.).

As such, in the case illustrated in FIG. 7, a comparatively great amount of heat transferred from the heating belt 52 to the pressurizing roller 54 when the pressurizing roller 54 was switched to rotating at the normal speed at the point when the temperature of the heating belt 52 reached the print-executable temperature. Accordingly, the temperature of the heating belt 52 was prevented from rising as desired and could not reach the fixing temperature (170° C.) at the point when the leading edge of the first recording sheet arrived at the fixing nip of the fixing device 5 following the commencement of the image forming operation with respect to the first recording sheet. As a result, fixing failure occurred.

In contrast, in the case illustrated in FIG. 9, a comparatively small amount of heat transferred from the heating belt 52 to the pressurizing roller 54 when the pressurizing roller 54 was switched to rotating at the normal speed at the point when the temperature of the heating belt 52 reached the print-executable temperature due to the difference between the temperatures being smaller by nearly 10° C. when compared to the former case. Accordingly, the temperature of the heating belt 52 was not prevented from rising, and the temperature of the heating belt 52 reached the fixing temperature (170° C.) at the point when the leading edge of the first recording sheet arrived at the fixing nip following the commencement of the image forming with respect to the first recording sheet. As a result, fixing failure did not occur.

Subsequently, comparison is performed of the experiment results illustrated in FIGS. 7 and 8. Even when the recovery temperature of the pressurizing roller 54 was comparatively low at 30° C., it was possible to increase the amount of heat transferring from the heating belt 52 to the pressurizing roller 54 during the warm-up operation by causing the pressurizing roller 54 to rotate at the normal speed upon commencement of the warm-up operation. That is, when the recovery temperature of the pressurizing roller 54 was comparatively low at 30° C., the rise of the temperature of the pressurizing roller 54 was comparatively great in the case illustrated in FIG. 8, where the pressurizing belt 54 was caused to rotate at the normal speed upon commencement of the warm-up operation, compared to in the case illustrated in FIG. 7, where the pressurizing belt 54 was caused to rotate at the low speed upon commencement of the warm-up operation. Accordingly, in the case illustrated in FIG. 8, the difference between the temperature of the heating belt 52 and the temperature of the pressurizing roller 54 (88° C.) at the point when the temperature of the heating belt 52 reached the print-executable temperature was 62° C., which was smaller by more than 20° C. compared to the difference between the temperatures in the case illustrated in FIG. 7. As such, in the case illustrated in FIG. 8, a comparatively small amount of heat transferred from the heating belt 52 to the pressurizing roller 54 when the pressurizing roller 54 was switched to rotating at the normal speed at the point when the temperature of the heating belt 52 reached the print-executable temperature due to the reduced difference between the temperatures. Accordingly, the temperature of the heating belt 52 was not prevented from rising, and the temperature of the heating belt 52 reached the fixing temperature (170° C.) at the point when the leading edge of the first recording sheet arrived at the fixing nip following the commencement of the image forming operation with respect to the first recording sheet. As a result, fixing failure did not occur.

In the meantime, in the case illustrated in FIG. 8, a comparatively great amount of time (17 seconds) was required until the temperature of the heating belt 52 reached the print-executable temperature compared to in the case illustrated in FIG. 7 (14 seconds).

Taking such results into consideration, when the recovery temperature of the pressurizing roller is comparatively low at 30° C., it is considered more desirable to cause the pressurizing roller 54 to rotate at the normal speed upon commencement of the warm-up operation than to cause the pressurizing roller 54 to rotate at the low speed upon commencement of the warm-up operation in order to prevent the occurrence of fixing failure, even when taking into account the comparatively great amount of time required until the temperature of the heating belt 52 reaches the print-executable temperature when causing the pressurizing roller 54 to rotate at the normal speed upon commencement of the warm-up operation.

Subsequently, comparison is performed of the experiment results illustrated in FIGS. 9 and 10. When the recovery temperature of the pressurizing roller 54 was comparatively great at 45° C., the temperature of the heating belt 52 reached the fixing temperature (170° C.) at the point when the leading edge of the first recording sheet arrived at the fixing nip upon commencement of the image forming operation with respect to the first recording sheet regardless of the rotation speeds at which the pressurizing roller 54 were caused to rotate upon commencement of the warm-up operation. As a result, fixing failure did not occur in either of the case illustrated in FIG. 10, where the pressurizing roller 54 was caused to rotate at the normal speed upon commencement of the warm-up operation, and the case illustrated in FIG. 9, where the pressurizing roller 54 was caused to rotate at the low speed upon commencement of the warm-up operation. However, in the case illustrated in FIG. 10, since the pressurizing roller 54 was caused to rotate at a faster speed upon commencement of the warm-up operation than in the case illustrated in FIG. 9, the difference (39° C.) between the temperature of the heating roller 52 and the temperature of the pressurizing roller 54 (111° C.) at the point when the temperature of the heating belt 52 reached the print-executable temperature was even smaller compared to the difference between the temperatures (76° C.) in the case illustrated in FIG. 9.

In the meantime, the amount of heat transferring from the heating belt 52 to the pressurizing roller 54 during the warm-up operation was greater in the case illustrated in FIG. 10, where the pressurizing roller 54 was caused to rotate at the normal speed which is faster in speed than the low speed upon commencement of the warm-up operation, compared to in the case illustrated in FIG. 9, where the pressurizing roller was caused to rotate at the low speed upon commencement of the warm-up operation. Due to this, the rise of the temperature of the heating belt 52 during the warm-up operation was delayed in the case illustrated in FIG. 10, where the pressurizing roller 54 was caused to rotate at the normal rotation speed upon commencement of the warm-up operation, and accordingly, a greater amount of time was required for the temperature of the heating belt 52 to reach the print-executable temperature in the case illustrated in FIG. 10. In specific, according to the experiment results illustrated in FIG. 9, the time required for the temperature of the heating belt 52 to reach the print-executable temperature (i.e., the time required until the commencement of the image forming operation) was 13 seconds in the case illustrated in FIG. 9, where the pressurizing roller 54 was caused to rotate at the low speed upon commencement of the warm-up operation. In contrast, according to the experiment result illustrated in FIG. 10, the time required for the temperature of the heating belt 52 to reach the print-executable temperature was 15 seconds in the case illustrated in FIG. 10, where the pressurizing roller 54 was caused to rotate at the normal speed upon commencement of the warm-up operation. As such, the time required for the temperature of the heating belt 52 to reach the print-executable temperature in the case illustrated in FIG. 10, where the pressurizing roller 54 was caused to rotate at the normal speed upon commencement of the warm-up operation, was longer by 2 seconds compared to the time required for the temperature of the heating belt 52 to reach the print-executable temperature in the case illustrated in FIG. 9, where the pressurizing roller 54 was caused to rotate at the low speed upon commencement of the warm-up operation. As such, when the recovery temperature of the pressurizing roller 54 is comparatively high at 45° C., it is considered more desirable to cause the pressurizing roller 54 to rotate at the low speed upon commencement of the warm-up operation than to cause the pressurizing roller 54 to rotate at the normal speed upon commencement of the warm-up operation since a greater amount of time is required for the temperature of the heating belt 52 to reach the print-executable temperature when the pressurizing roller 54 is caused to rotate at the normal speed upon commencement of the warm-up operation compared to when the pressurizing roller 54 is caused to rotate at the low speed upon commencement of the warm-up operation.

From the experiment results explained above, it can be concluded that, by optimizing the speed at which the pressurizing roller is caused to rotate during the warm-up operation by setting the temperature threshold value so as to be higher than 30° C. and lower than or equal to 45° C., the risk of fixing failure occurring can be reduced while reducing the time required for the completion of the warm-up operation of the fixing device 5. In addition, by conducting similar experiments as the experiments explained above while setting the recovery temperature of the pressurizing roller 54 to various temperatures within the range of 30° C.-45° C., the temperature threshold value can be set with an even higher degree of accuracy.

(Modifications)

In the above, the present invention has been described based on an embodiment thereof. However, as a matter of course, the present invention is not limited to the above embodiment, and modifications such as presented in the following can be performed without departing from the spirit and the scope of the present invention.

(1) In the embodiment, the fixing device 5 includes the fixing roller 51, the heating belt 52, the heating roller 53, and the pressurizing roller 54. However, the present invention is not limited to this, and the fixing device can have any structure provided that a heating rotating body and a pressurizing rotating body are included therein. For instance, the fixing device 5 may include a heating roller and a pressurizing roller. In addition, the pressurizing rotating body included in the fixing device 5 may be a combination of (i) an endless pressurizing belt that is driven to rotate and that is provided in place of the pressurizing roller and (ii) a pressing member that applies pressure to the pressurizing belt from within the rotation path of the pressurizing belt.

(2) In the embodiment, explanation is provided that the rotation speed control processing is performed upon the recovery of the fixing device 5 from the sleep state. However, the timing at which the rotation speed control processing is performed is not limited to when the fixing device recovers from the sleep state, and may be performed at any timing provided that the rotation speed control processing is performed at the timing at which the warm-up operation of the fixing device is commenced. For instance, the rotation speed control processing may be performed when the warm-up operation of the fixing device is performed after the power of the printer 1 has been turned on. In addition, the rotation speed control processing may also be performed when the warm-up operation of the fixing device is performed following the occurrence of a jam or following the opening/closing of doors provided to the printer 1.

Further, although explanation is provided in the embodiment that the control unit 60 causes the fixing unit 5 to recover from the sleep state when receiving a print instruction, the present invention is not limited to this. The control unit 60 may release the sleep state of the fixing device, for instance, in cases where it can be expected that a print instruction will be issued, such as when a touch has been made to the touch panel of the liquid crystal display unit. In such cases, the control unit 60 performs a pre-warm-up control during a period from the recovery of the fixing device 5 from the sleep state until the actual reception of the print instruction. The pre-warm-up control refers to a control of causing the temperature of the heating rotating body to rise at a slower rate compared to when the warm-up operation is performed.

Further, in such cases, the control unit 60 acquires the detection temperature at the point when the print instruction is received following the cancellation of the sleep state as the recovery temperature (t), and thereby performs the rotation speed control processing. Note that the control unit 60 causes the fixing unit 5 to enter the sleep state once again when a print instruction is not issued even after the elapse of a predetermined interval following the execution of the pre-warm-up control.

The temperature of the fixing device 5 (the temperature of the pressurizing roller 54) upon commencement of the warm-up operation is most likely to fluctuate when the warm-up operation is performed following the recovery of the fixing device 5 from the sleep state, and therefore, the timing at which the warm-up operation is commenced following the recovery of the fixing device 5 from the sleep state is most desirable as the timing for performing the rotation speed control processing. However, since the temperature of the fixing device 5 (the temperature of the pressurizing roller 54) may also fluctuate due to influence from ambient temperature after the power of the printer 1 is turned on, the rotation speed control processing can also be performed at this timing. By performing the rotation speed control processing at such a timing, beneficial effects can be yielded such as the reduction in the amount of time required for the completion of the warm-up operation and the prevention of the occurrence of fixing failure.

(3) In the embodiment, explanation is provided that the recovery temperature of the pressurizing roller 54 upon the recovery of the fixing device 5 from the sleep state is detected by the temperature sensor 534. However, the present invention is not limited to this, and the recovery temperature of the pressurizing roller 54 may be estimated according to (i) the period of time during which the fixing device 5 was operated preceding the point when the fixing device 5 entered the sleep state (the continuous operation period of the fixing device 5 immediately preceding the sleep state) and (ii) the amount of time elapsing from the entry of the fixing device 5 into the sleep state to the cancellation of the sleep state (referred to hereinafter as the "sleep continuation period"). Further, the control unit 60 may perform the rotation speed control processing by using the estimated recovery temperature as an index value (recovery temperature (t)) indicating the recovery temperature of the pressurizing roller 54.

For instance, a recovery temperature estimation table may be created and preemptively stored to the printer 1 by the manufacturer of the printer 1, and the estimation of the recovery temperature of the pressurizing roller 54 may be performed by referring to this recovery temperature estimation table. In such a case, the recovery temperature estimation table is to be created so as to indicate the correspondence between the recovery temperature of the pressurizing roller 54, the continuous operation period of the fixing device 5, and the sleep continuation period. Such a correspondence can be specified by the manufacturer of the printer 1 by (i) causing the fixing device 5 to continuously operate over different continuous operation periods (for instance, one minute, five minutes, ten minutes, twenty minutes, and thirty minutes), (ii) suspending the supply of power to the fixing device 5 following the elapse of the different continuous operation periods, and (iii) measuring the recovery temperature of the pressurizing roller 54 upon the recovery of the fixing device 5 from the sleep state at predetermined time intervals (i.e., sleep continuation periods) following the suspension of the supply of power (for instance, ten minutes, thirty minutes, sixty minutes, ninety minutes, and one hundred and twenty minutes).

In specific, the control unit 60 may be caused to measure the continuous operation period of the fixing device 5 preceding the entry of the fixing device 5 into the sleep state and the sleep continuation period of the fixing device 5 by using a timer or the like. Further, the control unit 60 may estimate the recovery temperature of the pressurizing roller 54 corresponding to the continuous operation period and the sleep continuation period so measured by referring to the recovery temperature estimation table. FIG. 11 is a diagram illustrating a specific example of the recovery temperature estimation table.

In addition, instead of storing the above-described recovery temperature estimation table indicating the correspondence between the recovery temperature of the pressurizing roller 54, the continuous operation period of the fixing device 5, and the sleep continuation period to the printer 1, a table indicating the correspondence between the continuous operation period of the fixing device 5, the sleep continuation period, and the rotation speeds of the pressurizing roller 54 may be stored to the printer 1 as a recovery rotation speed selection table. In such a case, the control unit 60 may directly select the rotation speed of the pressurizing roller 54 corresponding to the continuous operation period and the sleep continuation period measured by referring to the recovery rotation speed selection table and commence the warm-up operation of the fixing device 5 while causing the pressurizing roller 54 to rotate at the selected speed.

For instance, a recovery rotation speed selection table as illustrated in FIG. 12 may be created, and the control unit 60 may select the rotation speed corresponding to the continuous operation period and the sleep continuation period having been measured. Note that in FIG. 12, "normal speed" indicates the above-described normal speed, "low speed" indicates a rotation speed corresponding to ½ of the normal speed, and "lowest speed" indicates the above-described low speed.

(4) When single color printing (for instance, monochrome printing) is performed, a smaller amount of toner is used in the image forming operation compared to when full color printing is performed. Due to this, the risk of fixing failure occurring when single color printing is performed is low even when heat-fixing is performed at a comparatively low fixing temperature compared to when full color printing is performed. Accordingly, the temperature threshold value to be applied when a single color image forming operation is performed may be set to a lower temperature compared to the temperature threshold value applied when performing a full color image forming operation is performed.

In specific, the manufacturer of the printer 1 may preemptively set both a temperature threshold value for the full color image forming operation and a temperature threshold value for the single color image forming operation (such that the temperature threshold value for the full color image forming operation is greater than the temperature threshold value for the single color image forming operation) and store both temperature threshold values to the temperature threshold value storing unit 607. In such a case, at the point when the warm-up operation of the fixing device 5 is to be commenced in the rotation speed control processing explained referring to FIG. 6, a specification is to be made of a print condition to be applied in performing the image forming operation, and when the print condition indicates the single color image forming operation, the judgment in Step S604 and the selection of the rotation speed of the pressurizing roller 54 is to be made by using the temperature threshold value for the single color image forming operation. On the other hand, when the print condition indicates the full color image forming operation, the judgment in step S604 and the selection of the rotation speed of the pressurizing roller 54 is to be made by using the temperature threshold value for the full color image forming operation.

By performing such a modification, the amount of time required for the completion of the warm-up operation can be reduced when the single color image forming operation is performed due to the low speed being selected as the speed at which the pressurizing roller 54 is caused to rotate during the warm-up operation for a wider range of temperatures compared to when the full color image forming operation is performed.

(5) In the embodiment, the rotation speed of the pressurizing roller 54 upon commencement of the warm-up operation can be selected from two rotation speeds, that is, the normal speed and the low speed, in the rotation speed control processing explained referring to FIG. 6. However, the present invention is not limited to this, and more than two rotation speeds may be provided as candidates in the selection of the rotation speed of the pressurizing roller 54 upon commencement of the warm-up operation depending upon the recovery temperature of the pressurizing roller 54.

In specific, the fixing speed table may be created such that a plurality of temperature threshold values are set, and such that the rotation speed to be selected as the rotation speed of the pressurizing roller 54 upon commencement of the warm-up operation becomes faster step-by-step as the recovery temperature of the pressurizing roller 54 decreases, whereas the rotation speed to be selected as the rotation speed of the pressurizing roller 54 upon commencement of the warm-up operation becomes slower step-by-step as the recovery temperature of the pressurizing roller 54 increases.

For instance, the fixing speed table may be created such that (i) when the recovery temperature of the pressurizing roller 54 is higher than or equal to 45° C., the low speed is selected, (ii) when the recovery temperature of the pressurizing roller 54 is higher than or equal to 35° C. and lower than 45° C., a semi low speed is selected (½ of the normal speed), and (iii) when the recovery temperature of the pressurizing roller 54 is lower than 35° C., the normal speed is selected.

By setting rotation speeds of the pressurizing roller 54 in the fixing speed table in such a manner, the selection of the speed at which the pressurizing roller 54 is caused to rotate upon commencement of the warm-up operation can be performed with a higher degree of appropriateness.

In addition, in the embodiment, the speed at which the pressurizing roller 54 is caused to rotate upon commencement of the warm-up operation is selected from the normal speed and the low speed in the rotation speed control processing explained referring to FIG. 6. However, the present invention is not limited to this, and the two rotation speeds from which the above-described selection is to be made in the rotation speed control processing may be any rotation speed provided that the two rotation speeds differ from each other (i.e., one rotation speed being faster/slower than the other).

CONCLUSION

An image forming apparatus pertaining to one aspect of the present invention, description on which has been provided above, is an image forming apparatus including a fixing device that includes a heating rotating body and a pressurizing rotating body forming a fixing nip by the pressurizing rotating body applying pressure to the heating rotating body, and commencing an image forming operation with respect to a recording sheet following a warm-up operation during which a temperature of the heating rotating body reaches a predetermined temperature that is lower than a fixing temperature, the image forming apparatus comprising: a temperature acquisition unit that acquires an index value indicating a temperature of the pressurizing rotating body upon commencement of the warm-up operation; and a control unit that is configured to when the index value is smaller than a predetermined threshold value, perform a first control of heating the heating rotating body until the temperature of the heating rotating body reaches the fixing temperature while causing the heating rotating body and the pressurizing rotating body to rotate at a first speed, and when the index value is equal to or greater than the predetermined threshold value, perform a second control of (i) heating the heating rotating body until the temperature of the heating rotating body reaches the predetermined temperature while causing the heating rotating body and the pressurizing rotating body to rotate at a second speed that is slower than the first speed and (ii) heating the heating rotating body until the temperature of the heating rotating body reaches the fixing temperature while causing the heating rotating body and the pressurizing rotating body to rotate at the first speed after the temperature of the heating rotating body reaches the predetermined temperature.

In the image forming apparatus, the predetermined threshold value may be set such that, when the control unit performs the second control under a condition that the index value is equal to the predetermined threshold value, the temperature of the heating rotating body reaches the fixing temperature before a leading edge of the recording sheet reaches the fixing nip during the image forming operation.

In the image forming apparatus, the warm-up operation may be commenced when the fixing device recovers from a sleep state thereof. In addition, in the image forming apparatus, the predetermined threshold value may indicate a temperature higher than 30° C. and lower than or equal to 45° C. Further, in the image forming apparatus, the first speed may equal a speed at which the heating rotating body and the pressurizing rotating body rotate during a heat-fixing operation performed by the fixing device after the temperature of the heating rotating body reaches the fixing temperature.

Additionally, in the image forming apparatus, the image forming operation may include a full-color image forming operation and a single-color image forming operation, the predetermined threshold value may be one of a first threshold value and a second threshold value, the first threshold value being for the full-color image forming operation and being greater than the second threshold value, the second threshold value being for the single-color image forming operation, and the control unit may judge whether the index value is smaller than the predetermined threshold value or greater than or equal to the predetermined threshold value by using the first threshold value when the full-color image forming operation is to be commenced and by using the second threshold value when the single-color image forming operation is to be commenced.

With the above-described structure, the image foaming apparatus pertaining to one aspect of the present invention realizes the following effects. When the temperature of the pressurizing rotating body is lower than the predetermined threshold value upon commencement of the warm-up operation, it can be assumed that the temperature of the heating rotating body cannot reach the fixing temperature at the point when the first recording sheet reaches the fixing nip following the commencement of the image forming operation if the warm-up operation, during which the heating rotating body is heated until the temperature thereof reaches the predetermined temperature that is lower than the fixing temperature, is performed while causing the two rotating bodies to rotate at a second speed that is slower than the first speed. Here, note that the image forming operation is commenced while causing the rotating bodies to rotate at the first speed when the temperature of the heating rotating body reaches the predetermined temperature.

As such, in the above described case where the temperature of the pressurizing rotating body is lower than the temperature threshold value upon commencement of the warm-up operation, the warm-up operation is performed while causing the rotating bodies to rotate at the first speed that is faster than the second speed according to the image forming apparatus pertaining to one aspect of the present invention. When the rotating bodies are caused to rotate at the first speed, the amount of heat transferring from the heating rotating body to the pressurizing rotating body is comparatively great. Due to this, the rise of the temperature of the pressurizing rotating body during the warm-up operation is accelerated, and accordingly, the difference between the temperatures of the two rotating bodies at the point when the temperature of the heating rotating body reaches the predetermined temperature is reduced. As a result, the amount of heat transferring from the heating rotating body to the pressurizing rotating body upon commencement of the image forming operation is reduced, and thus, the temperature of the heating rotating body rises as desired. As such, the temperature of the heating rotating body is able to reach the fixing temperature before the first recording sheet arrives at the fixing nip, and hence, the occurrence of fixing failure resulting from the temperature of the pressurizing rotating body being lower than the predetermined threshold value upon commencement of the warm-up operation is prevented.

In the meantime, when the temperature of the pressurizing rotating body is higher than or equal to the predetermined threshold value upon commencement of the warm-up operation, it is assumed that the temperature of the heating rotating body can reach the fixing temperature before the first recording sheet reaches the fixing nip upon commencement of the image forming operation when the warm-up operation, during which the heating rotating body is heated until the temperature thereof reaches the predetermined temperature, is performed while causing the rotating bodies to rotate at the second speed. Note that, similar as in the above, the image forming operation is commenced while causing the two rotating bodies to rotate at the first speed when the temperature of the heating rotating body reaches the predetermined temperature.

As such, when the temperature of the pressurizing rotating body is higher than or equal to the temperature threshold value upon commencement of the warm-up operation, the warm-up operation is performed while causing the rotating bodies to rotate at the second speed that is slower than the first speed according to the image forming apparatus pertaining to one aspect of the present invention. When the two rotating bodies are caused to rotate at the second speed, the amount of heat transferring from the heating rotating body to the pressurizing rotating body is comparatively small. Due to this, heat loss from the heating rotating body during the warm-up operation is suppressed, and accordingly, the amount of time required until the heating rotating body is heated to the predetermined temperature is reduced.

As such, by changing the speed at which the rotating bodies are caused to rotate upon commencement of the warm-up operation according to the temperature of the pressurizing rotating body upon commencement of the warm-up operation, the risk of fixing failure occurring is reduced at the same time as the amount of time required for the completion of the warm-up operation is reduced.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus including a fixing device that includes a heating rotating body and a pressurizing rotating body forming a fixing nip by the pressurizing rotating body applying pressure to the heating rotating body, and commencing an image forming operation with respect to a recording sheet following a warm-up operation during which a temperature of the heating rotating body reaches a predetermined temperature that is lower than a fixing temperature, the image forming apparatus comprising:

a temperature acquisition unit that acquires an index value indicating a temperature of the pressurizing rotating body upon commencement of the warm-up operation; and a control unit that is configured to when the index value is smaller than a predetermined threshold value, perform a first control of heating the heating rotating body until the temperature of the heating rotating body reaches the fixing temperature while causing the heating rotating body and the pressurizing rotating body to rotate at a first speed, and when the index value is equal to or greater than the predetermined threshold value, perform a second control of (i) heating the heating rotating body until the temperature of the heating rotating body reaches the predetermined temperature while causing the heating rotating body and the pressurizing rotating body to rotate at a second speed that is slower than the first speed and (ii) heating the heating rotating body until the temperature of the heating rotating body reaches the fixing temperature while causing the heating rotating body and the pressurizing rotating body to rotate at the first speed after the temperature of the heating rotating body reaches the predetermined temperature.

2. The image forming apparatus of claim 1, wherein the predetermined threshold value is set such that, when the control unit performs the second control under a condition that the index value is equal to the predetermined threshold value, the temperature of the heating rotating body reaches the fixing temperature before a leading edge of the recording sheet reaches the fixing nip during the image forming operation.

3. The image forming apparatus of claim 1, wherein the warm-up operation is commenced when the fixing device recovers from a sleep state thereof.

4. The image forming apparatus of claim 1, wherein the predetermined threshold value indicates a temperature higher than 30° C. and lower than or equal to 45° C.

5. The image forming apparatus of claim 1, wherein the first speed equals a speed at which the heating rotating body and the pressurizing rotating body rotate during a heat-fixing operation performed by the fixing device after the temperature of the heating rotating body reaches the fixing temperature.

6. The image forming apparatus of claim 1, wherein the image forming operation includes a full-color image forming operation and a single-color image forming operation, the predetermined threshold value is one of a first threshold value and a second threshold value, the first threshold value being for the full-color image forming operation and being greater than the second threshold value, the second threshold value being for the single-color image forming operation, and the control unit judges whether the index value is smaller than the predetermined threshold value or greater than or equal to the predetermined threshold value by using the first threshold value when the full-color image forming operation is to be commenced and by using the second threshold value when the single-color image forming operation is to be commenced.

* * * * *